United States Patent [19]

DiFrank et al.

[11] Patent Number: 4,686,931

[45] Date of Patent: Aug. 18, 1987

[54] APPARATUS FOR APPLYING A SOLVENT TO PLASTIC LABELS

[75] Inventors: Frank J. DiFrank, Toledo; Mark R. Tipping, Maumee, both of Ohio

[73] Assignee:. Owens-Illinois, Inc., Toledo, Ohio

[21] Appl. No.: 795,052

[22] Filed: Nov. 4, 1985

[51] Int. Cl.[4] ..... B05C 1/02

[52] U.S. Cl. ..... 118/50; 118/212; 118/221; 118/231; 118/259

[58] Field of Search ..... 118/50, 219, 221, 222, 118/259, 231, 212

[56] References Cited

U.S. PATENT DOCUMENTS

| | | | |
|---|---|---|---|
| 1,922,523 | 8/1933 | Bodkin | 118/221 X |
| 3,152,011 | 10/1964 | Gerard | 118/221 X |
| 4,465,544 | 8/1984 | Fischer et al. | 118/221 X |
| 4,574,020 | 3/1986 | Fosnaught | 118/212 X |

*Primary Examiner*—John P. McIntosh
*Attorney, Agent, or Firm*—Howard G. Bruss

[57] ABSTRACT

In the application of a volatile solvent to a plastic, roll-on label for a bottle, a large diameter solvent applicating roll is formed with small diameter gravure rolls that extend from the surface of the solvent applicating roll. The small diameter rolls are circumferentially spaced from each other a distance that is equal to the spacing between the leading edge and trailing edge of a plastic label carried on the surface of a transfer drum. The small gravure rolls are relatively rotatable with respect to the large roll and are supplied with solvent from behind within the large roll. As the small rolls contact the labels on the transfer drum, they will transfer solvent to the leading and trailing edges of the plastic labels thereby resulting in the adhesion of the leading edge of the label to a bottle that is in rolling contact with the transfer drum and after the bottle rolls along the drum to wind the label thereon, the trailing edge of the label will overlap and adhere to the leading edge, thus making a "solvent seal" thereon. The solvent is applied by the small gravure rolls that are rotated by contact with the label in one embodiment or by contact of drive rollers with the drum surface. A considerable saving in solvent is accomplished due to very little evaporation taking place.

6 Claims, 7 Drawing Figures

APPARATUS FOR APPLYING A SOLVENT TO PLASTIC LABELS

BACKGROUND OF THE INVENTION

The present invention relates to the application of a solvent for a plastic label material to the surface of a series of plastic labels that are transported on a rotary drum for subsequent application of the individual label to a container.

It has been known to apply labels to containers by interposing a glue between the label and the container and rolling the label over the container to provide a full wrap-around label on the container. When dealing with plastic labels, it has been suggested that hot-melt adhesives or quick drying adhesives be used since, in order to label containers at a fairly rapid rate, it is necessary to get the adhesive transferred to the leading edge of the label and then bring the container into contact with the adhesive. The adhesive must be sufficiently tacky to assure adhesion of the label to the container during the subsequent rolling of the container along the label carrying drum and then the subsequent overlapping of the trailing end of the label over the leading edge with an interposed adhesive. In the event the label, so applied, is to be heat shrunk about the container, it is essential that the adhesion of the overlap or seam of the sleeve label be sufficient to resist separation under the shrinkage temperature and the tension from the circumferential shrinkage. U.S. Pat. No. 4,323,416 discloses, for example, an apparatus for gluing a label to a container by adhering the label to the container and subsequently wrapping the label about the container by rolling it along a fixed surface with the overlapping ends being glued together. Hot melt adhesives have been used in these circumstances but they are considered messy and expensive, since heat is required to maintain the adhesive at a useable temperature.

A more recent development disclosed in U.S. patent application Ser. No. 555,758, filed Nov. 28, 1983 now U.S. Pat. No. 4,574,020, assigned to the assignee of the present invention, describes apparatus for applying plastic labels to containers, such as plastic bottles, by using a solvent for the plastic of the label as the system for adhering the label to the container and also for making an overlap seam by using a solvent applied to the trailing edge of a label that is rolled completely about the container and overlaps the leading edge of the label.

The disclosure of this U.S. patent application Ser. No. 555,758 further describes the application of the solvent to the label by utilizing an applicator roll having a gravure pattern thereon corresponding to the distinct solvent patterns to be applied to the label at the leading and trailing edges of the label. The applicator roll is in the form of a cylinder that is mounted for rotation about a vertical axis. The roll has a vertical, solvent fountain in contact with its surface and in operation the gravure pattern on the surface of the roll will pick up the solvent in the pattern with the pattern position and roll diameter being related to the label length. The leading and trailing edges of a label carried on a transfer drum, which is moved in synchronism with the gravure roll and in general in contact therewith, will have solvent transferred thereto. The fountain has its open vertical face in contact with the applicator roll during its rotation and the majority of the solvent is intended to be in the gravure pattern with only an extremely thin film incidentally covering the rest of the roll. This incidental, thin film will normally evaporate during the operation of the system between contact with the fountain.

SUMMARY OF THE INVENTION

An applicator roll for applying a solvent to specific areas of plastic labels that are fed in series to and are supported on the periphery of a drum that is rotating about its vertical axis with the labels engaging the applicator to transfer solvent thereto in which the applicator roll is in the form of a hollow cylinder with at least two, small diameter, elongated, gravure rolls carried by the cylinder and rotatable about their vertical axes relative to the cylindrical, applicator roll. The axes of the gravure rolls are circumferentially spaced a distance that is equal to the space between the trailing edge of a label carried on the drum and the leading edge of the next, succeeding label on the drum. The interior of the cylinder is supplied with solvent and provides solvent to the gravure rolls whose surface is exposed to the solvent that is then transferred to the labels by frictional contact of the gravure rolls with the moving label supporting drum.

With the foregoing in view, it is an object of the present invention to provide an apparatus and method for applying solvent to a plastic label for the purpose of gluing the label to a container in which a significant saving in solvent may be accomplished and with a more positive system for transferring the solvent to the labels at the appropriate areas.

It is a further object of the invention to apply the solvent to the labels with apparatus which will greatly reduce the evaporation of solvent in and around the label applying apparatus.

Other and further objects will become apparent from a reading of the following detailed description taken in conjunction with the annexed sheets of drawings.

DETAILED DESCRIPTION OF THE DRAWINGS

Figure 1:
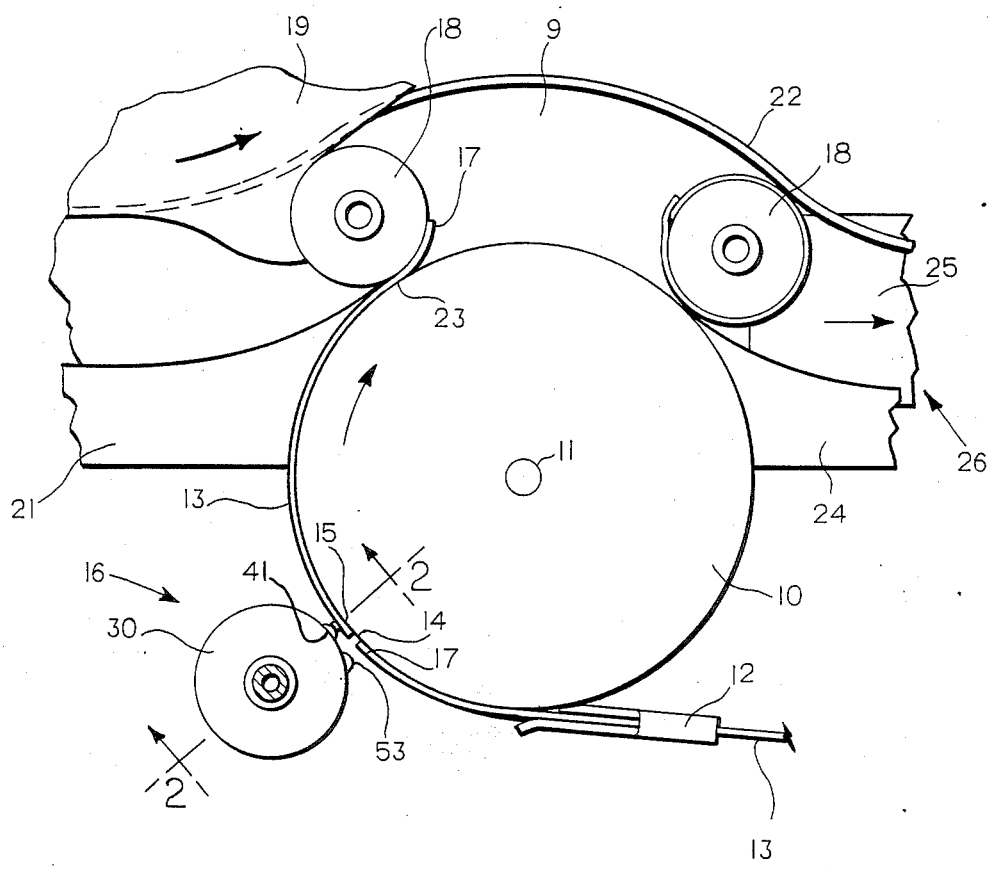
FIG. 1 is a schematic top plan view of a bottle labeling apparatus of which the present invention forms a part.

With particular reference to FIG. 1, wherein a top plan view is schematically shown of a label applying system in which labels are adhered to glass containers in such a manner that the label is completely wrapped about the sidewall circumference of the container while the container is transported in a vertical attitude through the labeling system. It should be kept in mind that the present invention is essentially directed to the application of a solvent to the leading and trailing edge of a plastic label in the labeling system as more fully described in U.S. application Ser. No. 555,758, filed Nov. 28, 1983 now U.S. Pat. No. 4,574,020, and assigned to the assignee of the present invention. Thus, only that portion of the label applying and bottle handling system that is necessary to an understanding of the present invention will be described in detail herein.

With particular reference to FIG. 1, there is shown a cylindrical drum 10 which is rotatable about its central vertical axis 11 in the direction of the arrow shown thereon. Adjacent the periphery of the drum 10 is found a label guide 12 and an elongated strip of plastic label material which is cut in label 13 lengths after its arrival at the guide 12. It should be kept in mind that the drum 10 is a vacuum drum in the sense that vacuum passages extend outwardly to the vertical surface thereof at spaced intervals such that as the label material 13 is brought to the surface of the drum 10 it will be held against the surface of the drum 10 by the vacuum applied internally thereof. The vacuum application to the interior of label transport drums are conventional and is not described in detail nor shown in this disclosure. The label material may be in the form of a continuous web of printed labels which are cut into label lengths after their arriving in the guide 12 or they may be free cut labels carried in a magazine and fed serially to the guide 12. It should be understood that the labels 13 are fed in timed relationship to the rotation of the drum 10 so they will arrive at the drum surface in position to be held by the vacuum passages at a preselected point in the periphery of the drum. The individual labels will be separated on the periphery of the drum by a gap 14 and, as will be described in greater detail hereinafter, the trailing edge 15 of each label 13 will have a full height line of solvent applied thereto by a solvent application roll, generally designated 16, which is in the form of a vertical cylinder rotatable about its vertical axis. The leading edge 17 of the labels 13 will also have a solvent applied to its external surface by the solvent applicating roll 16. The leading edge 17 of the label 13, which is shown held entirely by the drum 10 and which is shown as having a solvent being applied to its trailing edge 15, has been engaged by a container 18 resting upright on a horizontal deadplate 9 and the leading edge 17 of the label 13 is adhered to the sidewall of the container. The container 18 is brought into contact with the leading edge 17 of the label 13 by the movement of a rotatable starwheel 19 moving in the direction of the arrow shown thereon. While part of a single starwheel 19 is shown, it should be understood that, depending upon the height of the container 18, the starwheel may be formed of several pocketed wheels vertically spaced above one another. The starwheel or pairs of starwheels are rotated about a vertical axis (not shown), which axis also is the axis of symmetry of a horizontal guide rail 21 which will effectively bring and guide the bottle or container 18 into engagement with the leading edge of the label at the point where the bottle will pass through a vertical plane which would extend from the central vertical axis 11 of the drum and the axis of rotation of the starwheel 19. Once the container 18 has left the guide rail 21 and has packed up the leading edge of the label 13, the container will be held against the periphery of the drum 10 by an outer guide rail 22. In actual practice, the periphery of the drum 10 is formed of a resilient rubber layer (not shown) and the surface of the guide rail 22 is likewise formed of a rubberlike frictional material such that the container 18 will be held against the label 13 and roll along the drum to roll the label up and wind it about the container 18. It thus can be seen that the portion of the guide rail 22, which is opposed to the drum 10 between a label pickup point 23 and a container exit guide 24 will have a curvature which is parallel with the circumference of the drum or, in other words, the guide rail 22 between the drop-off point for the guide rail 21 and the pickup point for the exit guide 24 will have a surface which is coaxial with respect to the drum axis 11. In this manner the label is rolled up on the container 18 and the overlapping areas will be pressed together between the guide rail and the drum surface prior to the arrival of the container 18 at the exit guide 24. After passing into contact with the exit guide 24, the bottle 18 will reach the upper surface 25 of a generally horizontal conveyor 26 for conveying the container to the right, as viewed in FIG. 1.

Figure 2:
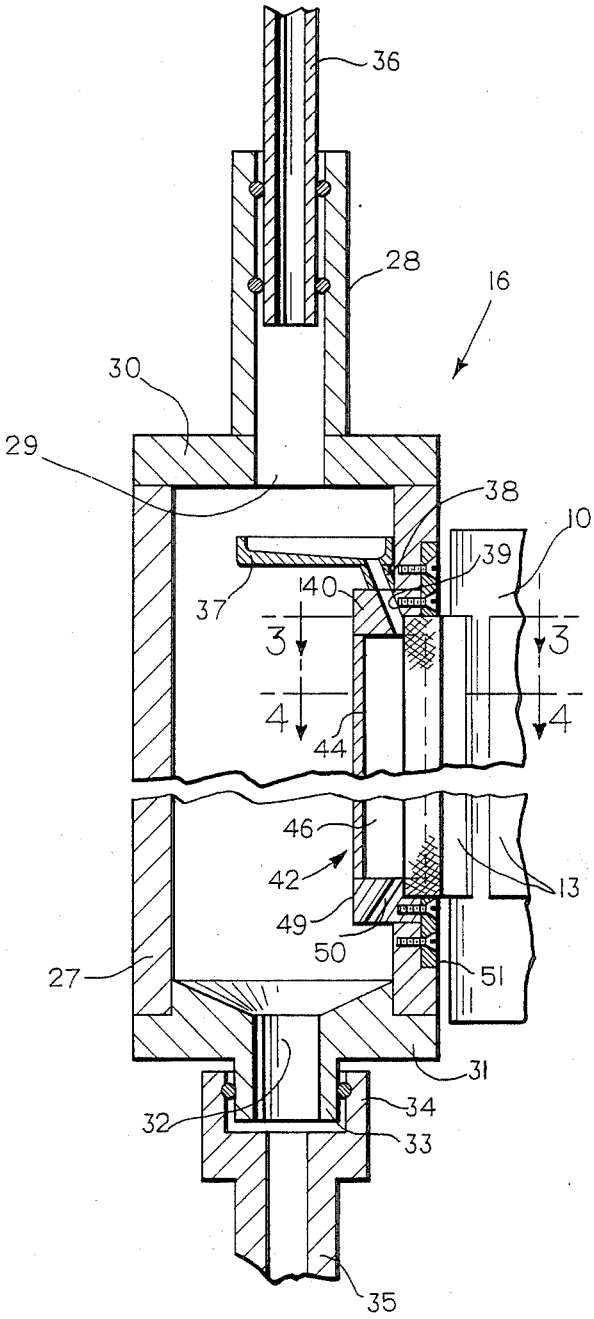
FIG. 2 is an enlarged, cross-sectional view of a first embodiment of the applicator roll of the present invention taken at line 2—2 of FIG. 1.
Figure 3:
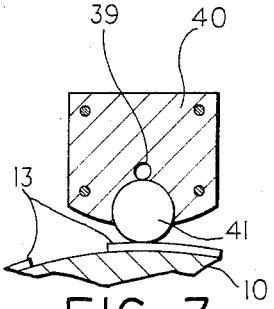
FIG. 3 is a cross-sectional view taken at line 3—3 of FIG. 2.

Turning now to FIGS. 2–5, the description of the solvent applicating roll of the invention will be described. The solvent applicating system or roll 16 takes the form of a generally hollow cylindrical body 27. An axially extending tubular member 28 is in alignment with an opening 29 in the upper wall 30 of the cylindrical body 27. Similarly, a bottom wall 31 having an axial opening 32 therein is formed with a downwardly extending annular portion 33. The annular portion 33 is adapted to extend within an upper open bell-like configuration 34 at the upper end of a pipe 35. The tubular member 28, as best seen in FIG. 2, surrounds a downwardly extending pipe 36. Thus it can be seen that the cylindrical body 27 has access to the interior thereof through the upper pipe 36 and may be drained through the lower pipe 35. Beneath the opening 29 within the interior of the cylindrical body 27 is positioned a generally flat trough 37. The trough 37 empties into a drain pipe 38 whose lower end is in communication with passage 39 in an upper bearing cap 40. The bearing cap 40 serves to surround and act as a bearing to the upper end of the gravure roll 41. The gravure roll has a gravure pattern ground or etched into its surface so that it may retain a certain amount of solvent therein in the interstices of the gravure pattern. The gravure roll 41 is supported by a generally rectangular elongated member 42.

Figure 4:
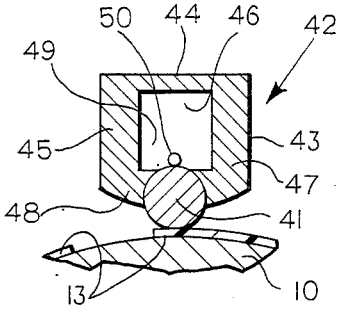
FIG. 4 is a cross-sectional view taken at line 4—4 of FIG. 2.
Figure 5:
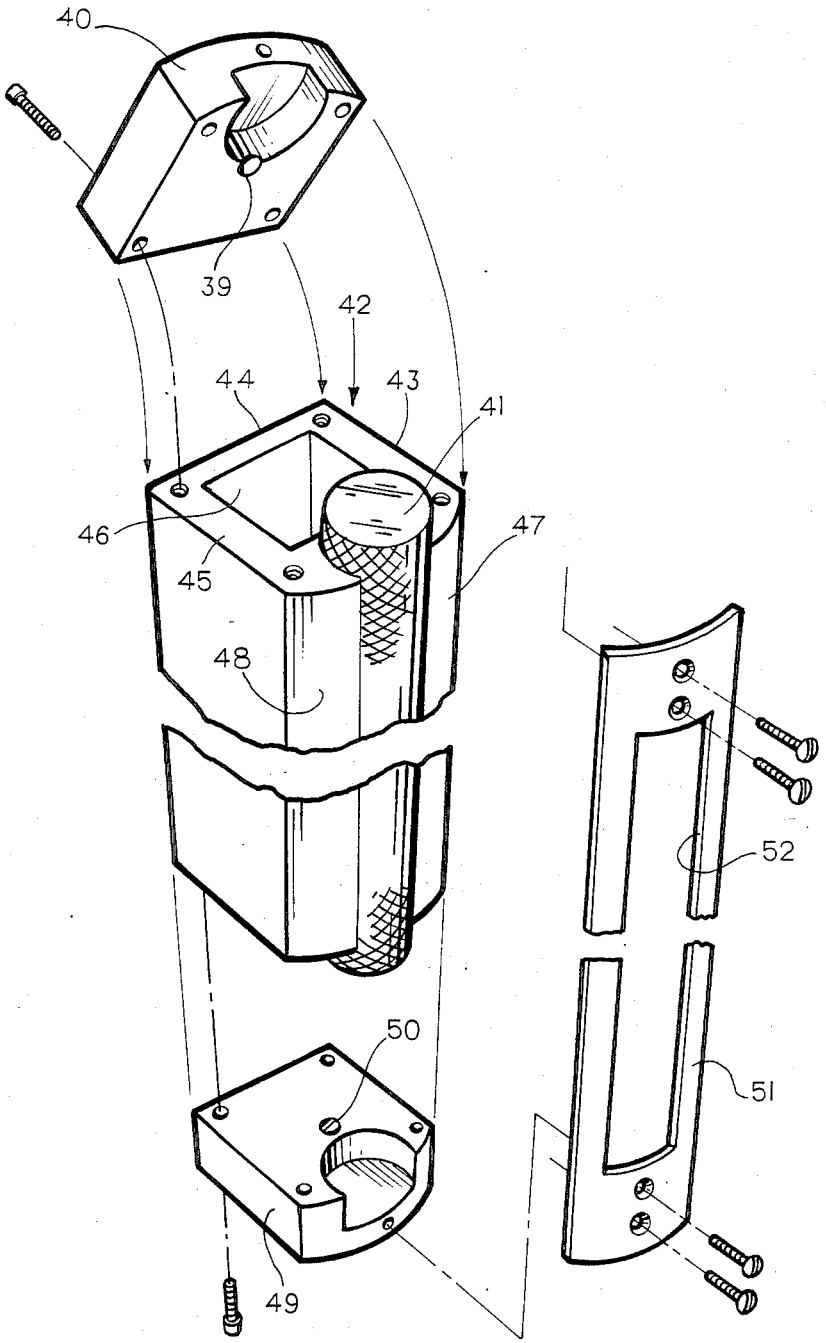
FIG. 5 is an exploded view of the gravure roll and holder of FIG. 2.

As can be seen in FIGS. 4 and 5, the member 42 is composed of three panels 43, 44 and 45. The panels are shown as being integrally connected together and form three sides of a hollow chamber 46. The fourth side of the chamber 46 is closed by the gravure roll 41 and a pair of opposed gravure gripping wall members 47 and 48. A lower bearing cap 49 closes the lower end of the chamber 46 and also serves as the bearing member for the lower end of the gravure roll 41. The cap 49 is affixed to the lower end of the hollow member 42 and in addition is provided with a drain opening 50. The hollow member 42 with the gravure roll and the bearing caps 40 and 49 are held in an opening formed in the cylindrical wall of the applicating roll 16 by a retaining plate 51. As can best be seen in FIG. 5, the retaining plate 51 is formed with a generally vertical rectangular opening 52 through which the gravure roll surface extends to a certain degree as illustrated in FIG. 2. The outer circumference of the gravure roll 41 will protrude through the rectangular opening 52 in the plate 51 and is positioned relative to the label transporting drum such that the gravure roll will engage the trailing edge of a label 13 supported by the drum 10. It should be understood that the solvent applicating roll 16 is rotated at an outer surface velocity which is significantly different than the surface velocity of the labels carried by the drum 10 so that, as the gravure roll contacts the label, the gravure roll will roll and apply solvent to the label due to the differential rotational speeds of the applicating roll 16 and the drum surface carrying the label.

While the foregoing description has been essentially directed to the single gravure roll 41 which applies the solvent to the trailing edge of the label 13, it being understood that the full height of the label trailing edge is provided with solvent inasmuch as this is the seam which is formed by overlapping the trailing edge over the leading edge when the label is applied to the container. Additionally, it is necessary that the label leading edge be provided with one or more solvent spots in order to provide the system for adhering the label to the bottle during its contact with the bottle at the point 23 illustrated in FIG. 1. This leading edge applicating system is essentially the same as that shown in detail with respect to FIGS. 2–5; however, it is not necessary that a full height gravure roll be used and in fact two vertically spaced gravure rolls 53 which have the same diameter as the diameter of the gravure roll 41 but are of considerably less length are mounted so as to receive solvent from the trough 37 into the hollow chambers formed behind the gravure roll or rolls in the same manner as that shown with respect to gravure roll 41 and thus the small gravure roll 53 will apply solvent to the leading edge 17 of the label 13. While the solvent applicating roll 16, as shown in FIG. 1, shows the cylindrical body 27 supporting the gravure rolls 41 and 53 at appropriately circumferentially spaced positions thereon, it should be understood that additional sets of gravure rolls 41 and 53 could be spaced about the circumference of the solvent applicating roll 16 and that its rotational velocity could be adjusted such that the pairs or sets of gravure rolls will apply the solvent to the leading and trailing edges of the labels as they are transported past the rotating applicating roll 16 by the drum 10.

Figure 6:
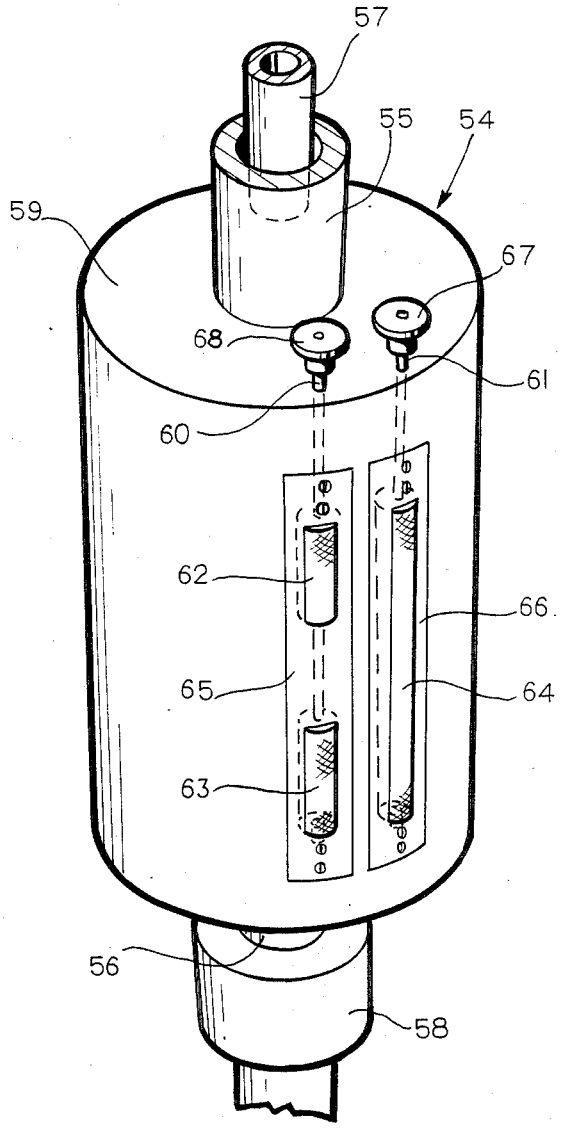
FIG. 6 is a perspective view of a second embodiment of a solvent applicating roll of the invention.
Figure 7:
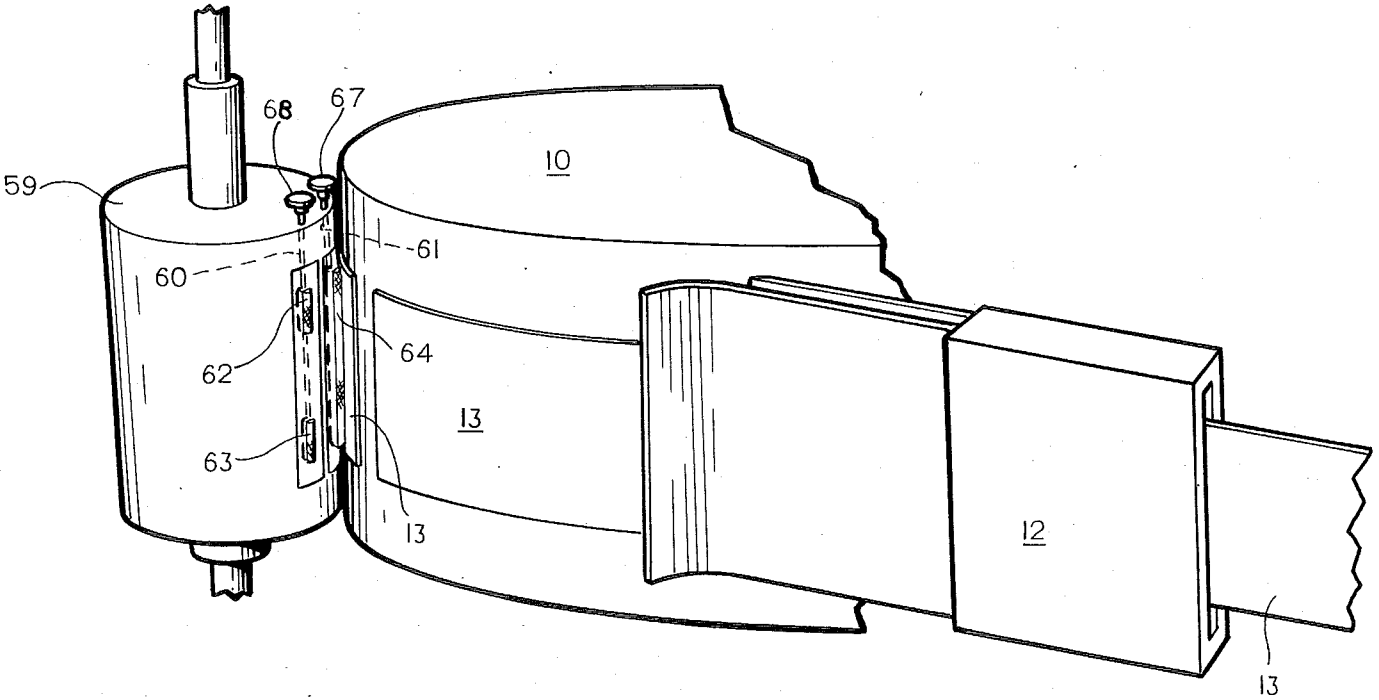
FIG. 7 is a perspective view of the applicator roll of FIG. 6 shown in conjunction with a label supporting and transport roll.

Turning now to FIGS. 6 and 7, there is illustrated a second embodiment of the applicating roll of the invention. In this embodiment a hollow cylindrical member 54 is provided with axially aligned upper and lower tubular members 55 and 56, respectively. These tubular members in turn cooperate with pipes 57 and 58. Extending through an upper wall 59 of the cylindrical body 54 are a pair of vertical shafts 60 and 61. The shaft 60 extends downwardly and rotatably supports a pair of gravure rolls 62 and 63. The gravure rolls 62 and 63 are substantially identical to the gravure rolls 53 of the previously described embodiment. The shaft 61 extends vertically downward and supports a gravure roll 64 which is essentially similar to the gravure roll 41, it being the single gravure roll that has the same height as the label that is being applied and will apply the solvent to the trailing edge of the labels while the gravure rolls 62 and 63 will apply solvent to two areas at the leading edge of the labels 13 being transported by the drum 10. As in the first embodiment, all the gravure rolls are held in the forward wall of rectangular chambers (not shown) within which solvent will be fed from the inner pipe 57 and the solvent, after filling the reservoirs behind the sets of gravure rolls, will exit downwardly through the drain pipe 58. The gravure rolls supporting chambers are retained, relative to the cylindrical body 54, by a pair of plates 65 and 66 in the same manner as the previously described plate 51 holds the solvent fountain or solvent supply body 42 at the surface of the body 27 forming the solvent applying roll of the first embodiment.

The significant difference between the first embodiment and this second embodiment is the fact that the gravure rolls are connected by the vertical shafts 60 and 61 to the upper ends of which are attached wheels 68 and 67. The wheels 68 and 67 are of a diameter and are positioned relative to the roll or cylindrical body 54 and the diameter of the gravure rolls such that they will contact the surface of the drum 10 as the labels approach the gravure rolls. In this manner the gravure rolls are positively driven by frictional engagement of the wheels 68 and 67 with the surface of drum 10 to rotate the gravure rolls 64 and 62 and 63 at the appropriate position when the gravure rolls are opposite the drum 10 and the labels carried thereby. The gravure rolls are driven so that they will apply solvent to the labels at the appropriate positions thereon by engagement of the wheels 68 and 67 by the outer wall of the drum 10.

While the foregoing sets forth the best mode contemplated by the inventor for carrying out the solvent applying system to labels transported by a rotating drum, it should be apparent that other similar systems could be used. However, it is the present system which provides a closed solvent system of the solvent applicating to the labels. As can be seen when viewing FIGS. 2–5, the solvent which will arrive and be distributed to the interior of the hollow member 42 which supports the gravure roll 41 and a similar hollow member which will be supporting the gravure rolls 53 in the first embodiment and also supporting the gravure rolls 62–64 in the second embodiment provide a system wherein the solvent only is present at the back of the gravure rolls and rotation of the gravure rolls, either by frictional engagement with the labels as in the first embodiment of FIG. 2 or by positive drive as in the second embodiment of FIGS. 6 and 7, will bring solvent from behind, up to, and wipe the solvent onto the labels. Very little solvent is therefore exposed to the atmosphere and very little solvent will evaporate into the atmosphere surrounding the labeling machine. The obvious advantages are that less solvent is needed than that in the previously referred to U.S. patent application Ser. No. 555,758 where solvent is present about the drum since the wiping of the drum is never sufficient to exclude or prevent some solvent being carried about the surface of the drum even if in a fairly thin film. In the present invention, the solvent is only applied through the relatively small miniature gravure rolls used to carry the solvent from the reservoir to the labels.

Other and further embodiments may be resorted to within the spirit and scope of the appended claims.

What is claimed:

1. An applicator roll for applying solvent at finite areas of a label being moved in tangential rolling contact with the roll where the labels are fed in series to and held to the surface of a rotating vacuum drum with its surface moving in solvent transfer relationship to the solvent applicator roll to thereby apply solvent to the label, the improvement in said applicator roll comprising a plurality of elongated, vertical, miniature gravure rolls set in the periphery of the applicator roll, each gravure roll being mounted for rotation about its vertical axis relative to said applicator roll with the periphery of each gravure roll extending slightly beyond the outer surface of the applicator roll, means connected to said applicator roll for rotating said applicator roll about its central vertical axis, and means for supplying solvent to the periphery of the gravure rolls.

2. The applicator roll of claim 1 wherein said roll is a hollow cylinder having vertical openings in the side thereof through which the periphery of each gravure roll extends, a hollow chamber fixed to the inner wall of said applicator roll and surrounding each gravure roll.

3. The applicator roll of claim 2 further comprising an upper and lower cap for the ends of each gravure roll for supporting the gravure rolls and closing the hollow chambers at their top and bottom.

4. The applicator roll of claim 3 wherein said means for supplying solvent to the gravure rolls comprises a feed passage in each upper cap and means mounted in said applicator roll for directing solvent to said feed passages in said upper caps.

5. The applicator roll of claim 1 further including a vertical shaft extending axially from each gravure roll, means mounting each said shaft in said applicator roll for rotation about the vertical axis of its respective gravure roll.

6. The applicator roll of claim 5 further including a horizontal wheel attached to each vertical shaft, each such wheel having a radius greater than the radius of the gravure roll, whereby the wheels will engage the rotating vacuum drum surface and be rotated by contact therewith.

* * * * *